United States Patent [19]

Eveland

[11] Patent Number: 4,932,884

[45] Date of Patent: Jun. 12, 1990

[54] CONTROLLED IMPEDANCE CONTACTS

[75] Inventor: James A. Eveland, San Francisco, Calif.

[73] Assignee: Trigon Industries, Inc., Milpitas, Calif.

[21] Appl. No.: 179,933

[22] Filed: Apr. 11, 1988

[51] Int. Cl.[5] ..... H01R 9/09; H01R 13/15

[52] U.S. Cl. ..... 439/68; 439/260; 439/668

[58] Field of Search ..... 439/68, 77, 84, 95, 439/96, 259–261, 668

[56] References Cited

U.S. PATENT DOCUMENTS 4,270,826 6/1981 Narozny ..... 439/260

4,493,526 1/1985 Masuda ..... 439/668

*Primary Examiner*—P. Austin Bradley

*Attorney, Agent, or Firm*—Rosenblum, Parish & Bacigalupi

[57] ABSTRACT

A disengageable electrical connector structure in which a flexible contact finger is attached to a stationary base and dielectrically isolated from a stationary ground shield attached to the base to facilitate controlling the impedance of the contact finger when in a contact position connecting an electrical circuit to a lead of an electronic device.

18 Claims, 1 Drawing Sheet

CONTROLLED IMPEDANCE CONTACTS

BACKGROUND OF THE INVENTION

1. Field of the Invention

The present invention relates generally to electrical contacts, and more particularly to disengageable contacts with dielectric shielding.

2. Discussion of the Prior Art

Electrical circuits are often provided with disengageable contacts for making electrical connections to leads of electronic devices so that the devices can be readily installed and removed to test the device or circuit or to repair or replace the device. In high frequency electronic circuits, electrical "signal path" connections may need to be isolated from external electrical interference by being at least partially surrounded with a non-conductive gap and ground shield. In critical applications, the non-conductive gap dimensions must be precise to provide a specified impedance in the signal path.

FIGS. 1*a*, 1*b*, 2*a* and 2*b* represent typical prior art disengageable contacts for coupling an electronic device 2 lead 3 to a circuit terminal 4 and to a ground terminal 5 by means of conventional connectors 10 and 20. In FIG. 1*a*, connector 10 is formed by a base 11 holding a flexible conductive ground shield 12 connected to ground terminal 5, and a flexible conductive "contact finger" 13 connected to circuit terminal 4. Contact finger 13 is a resilient member which is typically either electrically conductive or coated with electrically conductive material. Finger 13 is spaced by a gap 14 from shield 12, and isolated by isolator means 15 in the form of a solid dielectric 16 sandwiched in gap 14. In FIG. 2*a*, connector 20 is formed by a base 21 holding flexible conductive ground shield 22, flexible conductive contact finger 23, and isolator means 25 in the form of a solid insulating block 26 with a fluid (typically air) as a dielectric 27 in gap 24.

As shown in FIGS. 1*b* and (2*b*), actuator 18 directly, or actuator (28) through device 2, moves contact 13 (23), isolator means 15 (25), and shield 12 (22) together, generally maintaining the contact and the shield parallel to and isolated from each other to maintain a specified impedance wherever they stop their movement. The contact finger may be flexed by the actuator 18 (28) through moving the electronic device, the shield, or directly. The contact finger may be formed straight or bent, and then deformed towards or away from the lead of the device. However, in a connector with the contact finger and the shield being curved together, they slide lengthwise against each other, and it is difficult to maintain the consistency of the dielectric isolation between them. Where, as in FIGS. 1*a* and 1*b*, the dielectric is a flexible solid material 16 which maintains the size of gap 14, bending the contacting arrangement generates friction which opposes the actuator and wears out the connector. Where, as in FIGS. 2*a* and 2*b*, the dielectric is a fluid 27, a spacer such as block 26 is needed to maintain gap 24 between conductors 22 and 23. A solid block 26 generally has a different dielectric value than the fluid 27 and interrupts the electrical relationship between contact 23 and shield 22. In addition, the size of gap 24 is uncontrolled around the fluid dielectric 27 space, and as shown in FIG. 2*b* shield 22 may become curved to a different radius than contact finger 23, distorting the size of gap 24 and the electrical relationship between conductors 22 and 23.

Conventional connectors in which both the contact finger and the ground shield move are difficult to design, manufacture, install, use and maintain so as to precisely control the electrical relationship between the moving members. When an additional electrical component, such as a decoupling capacitor, must be connected to the contact finger or ground shield as close as possible to the device lead where the finger or shield will be flexed, it is difficult to connect the additional component.

Finally, the contact finger and ground shield must be connected by joints to a circuit terminal 4 and to a ground terminal 5. It is difficult to minimize the discontinuity in impedance of such joints in moving conductors.

Thus, there is a need for a convenient, reliable and economical disengageable contact means with consistent dielectric shielding from external electrical interference.

SUMMARY OF THE PRESENT INVENTION

It is therefore a primary objective of the present invention to provide an improved connection for establishing and controlling the electrical relationship between a moveable contact finger and an associated ground shield.

Briefly, preferred embodiments of the present invention include a base, a stationary ground shield, a moveable contact finger, and an isolating means including a dielectric either held stationary relative to the shield or allowed to move with the finger. The invention may be embodied as a discrete contacting arrangement or as part of a printed circuit board.

Among the advantages of the present invention compared to the prior art, one advantage is that contacts with a stationary (ground shield) conductor and only one moving (contact finger) conductor are easier to design and manufacture. A fixedly disposed ground shield provides a definite "contact position" which is the only contact finger position where the dielectric value actually needs to be controlled. Another advantage is that one flexible (contact finger) conductor's movement to one particular "contact position" is more easily and accurately controllable than two moving conductor's movements. Holding the ground shield stationary in the invention also facilitates adjusting the dielectric isolation of the contact finger, and immobilizing the ground shield simplifies connecting additional components to either the ground shield or the contact finger. Finally, having the ground shield stationary facilitates compensating for impedance discontinuities in joints between the contact and shield conductors and respective terminals of the circuit and of the ground potential.

These and other objects and advantages of the present invention will become apparent to those skilled in the art upon reading the following detailed description of the preferred embodiments shown in the accompanying drawing figures.

DETAILED DESCRIPTION OF THE PREFERRED EMBODIMENTS

Figure 1A:
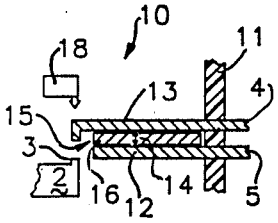
FIGS. 1*a* and 1*b* are cross-sections of a prior art contact in a non-contact position and in a contact position respectively.
Figure 1B:
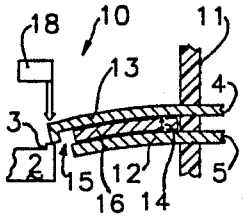
PRIOR ART Fig. 1b
Figure 2A:
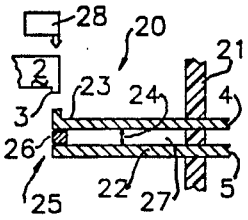
PRIOR ART Fig. 2a
FIGS. 2*a* and 2*b* are cross-sections of another prior art contact in non-contact and contact positions, respectively.
Figure 2B:
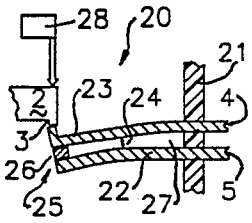
PRIOR ART Fig. 2b
Figure 3A:
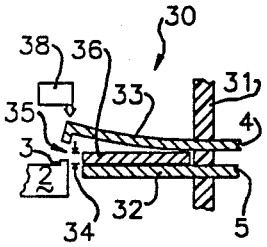
PRIOR ART Fig. 3a
FIGS. 3*a*, 3*b*, and 4*a*, 4*b* are cross-sections of the invention in embodiments in which the contact finger is directly actuated by an actuating means.
Figure 3B:
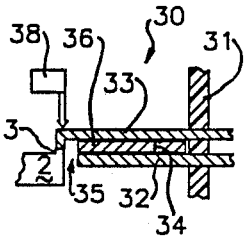

FIGS. 3*a* and 3*b* show the invention in an embodiment as a disengageable connector 30 including a base 31, a stationary conductive shield 32 and a flexible contact "finger" 33 with respective attachment portions mounted in base 31 at locations spaced apart by a gap 34 and electrically isolated from each other by isolator means 35. The finger 33 approach to shield 32 is limited by isolator means 35 with solid spacer dielectric material 36, which is optionally a plastic strip attached to base 31. Contact finger 33 is formed in a non-contact curved position with its distal end out of contact with, and diverging from, dielectric 36 and shield 32.

From the non-contact position, finger 33 may be mechanically biased and deformed downwardly by an actuator 38 as shown in FIG. 3*b* without encountering friction from stationary isolator dielectric 36 or shield 32 until the distal end of finger 33 touches device lead 3. Upon reaching lead 3, finger 33 is further pressed and straightened into a "contact position," where finger 33 is uniformly parallel to shield 32 and has a consistent dielectric isolation from, and predetermined electrical coupling to, shield 32.

Figure 4A:
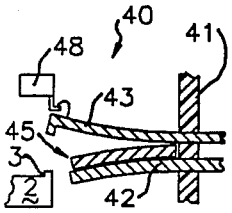
Figure 4B:
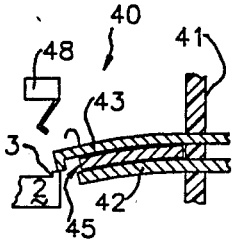

FIG. 4*a* shows the invention in an embodiment as a connector 40 including a base 41, a curved shield 42, a contact finger 43, and curved isolator means 45 which is optionally attached to shield 42. Contact finger 43 is formed in the "contact position" parallel to shield 42, and is deformable upward to the non-contact position when pulled by actuator 48 to allow placing a device 2 under the finger as shown in FIG. 4*a*. When released, finger 43 resiliently returns to the contact position where it remains as shown in FIG. 4*b* without being held by actuator 48.

Figure 5A:
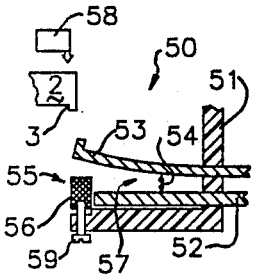
Figure 5B:
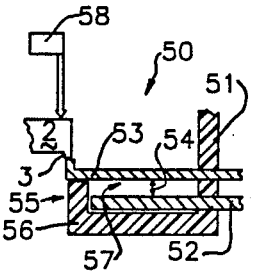

FIG. 5*a* shows the invention in an embodiment as a connector 50 including base 51, shield 52, contact 53 separated from shield 52 by a gap 54, and isolator means 55 including solid spacer 56 and using air 57 as a dielectric in gap 54. Contact finger 53 is formed in a non-contact curved position. Actuator 58 pushes device 2 against finger 53 to deform finger 53 until spacer 56 limits the approach of finger 53 to the contact position, as shown in FIG. 5*b*. Solid spacer means 56 optionally includes spacing adjustment means, such as a screw 59 as shown in FIG. 5*a*, for adjusting the size of gap 54 and "tuning" the impedance of the connection with the device 2 in place. Tuning the position of finger 53 may result in it having a contact position non-parallel to shield 52.

Figure 6A:
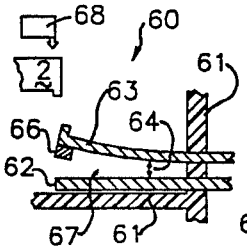
FIGS. 5*a*, 5*b* and 6*a*, 6*b* show the invention in embodiments in which the isolation means includes solid spacers and gaseous dielectrics.
Figure 6B:
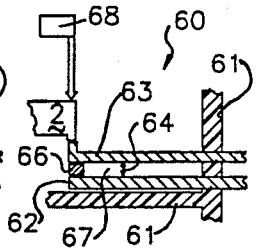

FIG. 6*a* shows the invention in an embodiment as a connector 60 including base 61, shield 62, contact finger 63 separated from shield 62 by a gap 64, and insulator spacer means 66 attached to finger 63 with a gaseous (air) dielectric 67 in gap 64. Actuator 68 pushes device 2 to deform finger 63 into the contact position where finger travel is stopped by spacer 66 as shown in FIG. 6*b*. Solid spacer means 66 is optionally replaceable by another spacer (not shown) with a selected different height to adjust the size of gap 64.

Figure 7A:
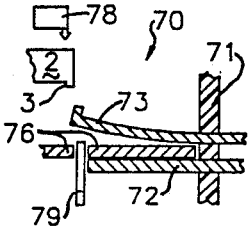
FIGS. 7*a* and 7*b* show the invention in an embodiment including a conductive jumper.
Figure 7B:
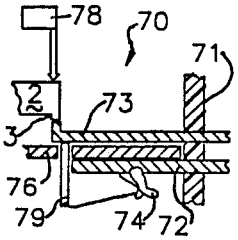

FIGS. 7*a* and 7*b* show the invention in an embodiment as a connector 70 including base 71, shield 72, and contact 73 separated from shield 72 by a gap occupied by solid spacer dielectric 76. In this and in the other embodiments, freeing the ground shield from the constraint of moving along with the contact finger facilitates connecting another component lead such as a probe or a clip 74 to shield 72 or to the contact finger 73 in close proximity to the device lead 3. As shown in FIGS. 7*a* and 7*b*, connector 70 is preferably provided with a conductive jumper 79 disposed in one or more of base 71, spacer 76, and/or dielectric 77, so that the jumper will be contacted by finger 73 while in the contact position. Jumper 79 may be connected by a clip 74 to shield 72 to decouple finger 73, or jumper 79 may be connected to other circuitry (not shown).

Figure 8A:
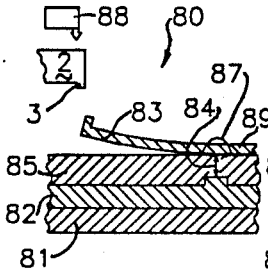
FIGS. 8*a* and 8*b* show the invention embodied in a printed circuit board.
Figure 8B:
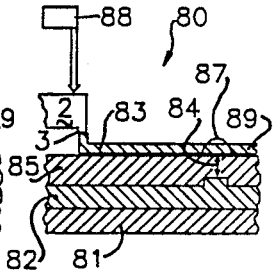

FIGS. 8*a* and 8*b* show the invention as a connector 80 embodied in a printed circuit board including a non-flexible backing base 81, a ground plane shield 82, a plastic layer of dielectric 85, and a contact finger 83 in the form of a conductive trace partially laminated to the top surface of dielectric layer 85. Stationary ground shield layer 82 enables forming dielectric layer 85 with a modified thickness in gap 84 between shield 82 and contact finger joint 87 to compensate for any discontinuity in the impedance of the signal path between contact finger 83 and circuit "terminal" 89. In addition, a conductive jumper (not shown) similar to jumper 79 may be embedded in isolation layer 85 as a "feed-through" to shield 82 or another layer (not shown) in the circuit board.

Although the present invention has been described in terms of several preferred embodiments, those skilled in the art will appreciate that these embodiments may be modified without departing from the essence of the invention. It is therefore intended that the following claims be interpreted as covering any modifications falling within the true scope and spirit of the invention.

I claim:

1. Connector means for disengageably coupling a lead of a device to an electrical circuit terminal and to a ground terminal, comprising:

base means;

conductive shield means attached to said base means, connectable to said ground terminal, and having a surface area stationarily disposed relative to said base means;

conductive contact means having a first end attached to said base means in a position spaced from said shield means and connectable to said circuit terminal, a surface area, and a distal second end for contacting said device lead, and being resiliently deformable from one to the other of a contact position where said contact surface area is parallel to said shield surface area and a non-contact position where said contact surface area is non-parallel to said shield surface area; and isolator means disposed between the two said conductive means, for limiting approaches of said contact means towards said shield means, and thereby providing a predetermined dielectrical relationship between said shield means and said contact means while said contact means is in said contact position.

2. Connector means as in claim 1 wherein said isolator means comprises solid spacer means.

3. Connector means as in claim 2 and further comprising conductive jumper means fixedly disposed relative to said shield means for contacting said contact means while in said contact position, said jumper means being connectable to a selected conductor.

4. Connector means as in claim 2 wherein said spacer means comprises a dielectric material.

5. Connector means as in claim 4 wherein said dielectric material is fixedly disposed relative to said shield means.

6. Connector means as in claim 5 wherein said dielectric material is attached to said shield means.

7. Connector means as in claim 6 wherein said base means comprises a layer of a printed circuit board, said shield means comprises a ground plane disposed over said layer, said dielectric material is disposed over said ground plane, and said contact means comprises a trace at least partially laminated over said dielectric material.

8. Connector means as in claim 2 wherein said spacer means comprises travel stop means and said isolator means comprises dielectric fluid disposed between said contact means and said shield means.

9. Connector means as in claim 8 wherein said travel stop means is adjustably disposed to enable altering the spacing between said shield means and said contact means in said contact position.

10. Connector means as in claim 8 wherein said fluid is air.

11. Connector means as in claim 2 and further comprising actuator means for deforming said contact means from one to the other of said contact position and said non-contact position.

12. Connector means as in claim 11 wherein said contact means is formed in said contact position and said actuator means deforms said contact means to said non-contact position.

13. Connector means as in claim 11 wherein said contact means is formed in said non-contact position and said actuator means deforms said contact means to said contact position.

14. Connector means as in claim 13 wherein said actuator means deforms said contact means from said non-contact position before said contact means contacts said device lead.

15. Connector means as in claim 13 wherein said actuator means moves the device having said lead which in turn contacts and deforms said contact means to said contact position.

16. Connector means of the type for connecting an electrical circuit to a lead of an electronic device, comprising:

base means;

conductive contact means attached to said base means, and being connectable to said circuit, and elastically deformable between a contact position for contacting said device, and a noncontact position;

conductive shield means attached to said base means proximate said contact means; and isolator means disposed between said contact means and said shield means for electrically isolating said contact means from said shield means, characterized in that said shield means is stationarily disposed relative to said base means and said contact means is movably disposed between a contact position parallel to said shield means and a noncontact position nonparallel to said shield means.

17. Connector means for disengageably coupling a lead of a device to an electrical circuit terminal and to a ground terminal, of the type formed by a base supporting a conductive shield having a surface area connectable to the ground terminal; movable conductive contact means having a first end attached to the base, a surface area connectable to the circuit terminal and a second end for contacting the device lead, and being resiliently deformable from one to the other of either a contact position where said contact surface area is nominally parallel to said shield surface area, or a non-contact position; and, isolator means for determining the electrical relationship between the shield and the contact means while the contact means is in said contact position; characterized in that:

said shield is supported stationarily with respect to said base, and the surface area of said contact means in said non-contact position is non-parallel to the surface area of said shield.

18. Connector means as recited in claim 17 wherein said contact means contacts said device lead in a direction substantially perpendicular to said contact surface area.

* * * * *